US009863169B2

(12) United States Patent
Barmscheidt

(10) Patent No.: US 9,863,169 B2
(45) Date of Patent: Jan. 9, 2018

(54) MOTOR-VEHICLE DOOR LOCK

(71) Applicant: Kiekert Aktiengesellschaft, Heiligenhaus (DE)

(72) Inventor: Christian Barmscheidt, Duisburg (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 361 days.

(21) Appl. No.: 14/435,302

(22) PCT Filed: Oct. 17, 2013

(86) PCT No.: PCT/DE2013/000609

§ 371 (c)(1),
(2) Date: Apr. 13, 2015

(87) PCT Pub. No.: WO2014/059966

PCT Pub. Date: Apr. 24, 2014

(65) Prior Publication Data

US 2015/0259952 A1 Sep. 17, 2015

(30) Foreign Application Priority Data

Oct. 18, 2012 (DE) ..... 10 2012 020 424

(51) Int. Cl.
*E05C 3/06* (2006.01)
*E05B 77/26* (2014.01)
(Continued)

(52) U.S. Cl.
CPC ..... *E05B 77/26* (2013.01); *E05B 77/265* (2013.01); *E05B 81/00* (2013.01); *E05B 81/14* (2013.01);
(Continued)

(58) Field of Classification Search
CPC ..... E05B 77/26; E05B 81/90; E05B 81/64; E05B 81/68; E05B 81/74; Y10S 292/65
See application file for complete search history.

(56) References Cited

U.S. PATENT DOCUMENTS 6,116,664 A * 9/2000 Wegner ..... E05B 81/66 292/201
7,125,057 B2 * 10/2006 Coleman ..... E05B 77/26 292/201
7,568,740 B2 * 8/2009 Brose ..... E05B 81/06 292/201

FOREIGN PATENT DOCUMENTS

DE 19706393 A1 10/1997
DE 19706393 B4 8/2004
(Continued)

OTHER PUBLICATIONS

English Translation of DE19706393A1 by Lexis Nexis Total Patent dated Apr. 24, 2015.
(Continued)

*Primary Examiner* — Mark Williams
(74) *Attorney, Agent, or Firm* — Woodard, Emhardt, Moriarty, McNett & Henry LLP

(57) ABSTRACT

The subject matter of the present invention is a motor-vehicle door lock which is equipped with a locking mechanism, further with an opening drive (3, 4) which acts on the locking mechanism, and also with an operating lever mechanism (6, 7). At least one sensor (8) for checking an operator opening request is further provided. Finally, a safety device (9, 10, 11), which prevents the locking mechanism (3, 4) from opening at least in its "safe" position, is provided. The invention makes provision for an intermediate lever (7) of the operating lever mechanism (6, 7), which intermediate lever mechanically converts the operator opening request, to selectively act on or not act on the sensor (8) which actuates the opening drive (3, 4), depending on the position of the safety device (9, 10, 11).

15 Claims, 2 Drawing Sheets

(51) Int. Cl.

| | |
|---|---|
| ***E05B 81/14*** | (2014.01) |
| ***E05B 85/00*** | (2014.01) |
| ***E05B 81/64*** | (2014.01) |
| ***E05B 81/00*** | (2014.01) |
| *E05B 81/06* | (2014.01) |
| *E05B 81/56* | (2014.01) |

(52) U.S. Cl.
CPC ..... *E05B 81/64* (2013.01); *E05B 85/01* (2013.01); *E05B 81/06* (2013.01); *E05B 81/56* (2013.01); *Y10T 292/108* (2015.04)

(56) References Cited

FOREIGN PATENT DOCUMENTS

| | | |
|---|---|---|
| DE | 202011002154 U1 | 6/2012 |
| EP | 13209652 | 6/2003 |

OTHER PUBLICATIONS

English Translation of DE19706393B4 by Lexis Nexis Total Patent dated Apr. 24, 2015.
English Translation of DE202011002154U1 by Lexis Nexis Total Patent dated Apr. 24, 2015.
English Translation of WO0231298A1 which published as EP1320652 by Lexis Nexis Total Patent dated Apr. 24, 2015.

* cited by examiner

MOTOR-VEHICLE DOOR LOCK

CROSS-REFERENCE TO RELATED APPLICATIONS

This application is the U.S. national stage application of International Patent Application No. PCT/DE2013/000609, filed Oct. 17, 2013, which claims priority of German Application No. 10 2012 020 424.8, filed Oct. 18, 2012, which are both hereby incorporated by reference.

BACKGROUND

The invention relates to a motor vehicle door lock comprising a locking mechanism as well as an opening drive acting on the locking mechanism, an operating lever mechanism and at least one sensor for checking an operator opening request as well as a safety device, which prevents opening of the locking mechanism at least in its "safe" position.

The opening drive of such motor vehicle door locks generally provides the so-called electric opening of the locking mechanism. In such an arrangement, a handle, such as an external operating lever and/or an internal operating lever, is not mechanically connected to the locking mechanism. Instead the sensor activated by an operator in case of a respective operator opening request ensures that the opening drive or the electric drive for opening the locking mechanism is supplied with current. As a result, the locking mechanism is opened by the motor and not by manual action. This is, in most cases, achieved by the opening drive pivoting a triggering lever, which in turn lifts a pawl off a rotary latch, being respective components of the locking mechanism.

Apart from the term "electric opening" respective literature also makes reference to "Open by Wire" in this context (see "Kraftfahrtechnisches Taschenbuch" published by Bosch, 24$^{th}$ edition, Apr. 2002, page 896 ff.). A considerable advantage of such systems is the option of being able to provide a so-called "Passive Entry" access to the respective motor vehicle. Such mechanisms require very fast unlocking actions or so-called "overtaking solutions". The "overtaking principle" refers to a process in which the opening drive has already opened the locking mechanism or has lifted the respective pawl off the rotary latch although a preceding unlocking action has not been fully completed. Consequently operators do not experience any waiting times.

A typical example for a motor vehicle door lock or a motor vehicle door lock with the described functionality for electric opening is disclosed and described in EP 1 320 652 B1. At this point, a distinction is made between a normal and an emergency operation. During normal operation, the electric drive acts on the locking mechanism for electric opening and ensures that in at least the emergency operation, the locking mechanism is mechanically opened. The emergency operation typically corresponds to an emergency opening, which is or can be required if the electric drive does no longer operate reliably or operate at all due to a drop of voltage in the vehicle. According to the known teaching and as part of the emergency operation, a mechanical operation—emergency opening—of the locking mechanism is then still possible.

A generic motor vehicle door lock is disclosed in DE 197 06 393 B4 in which different control electronics and respective signaling devices are employed. A centre-zero switch is, for instance provided on the external and the internal door handle. In addition, also the position of a child lock device as a safety device is sensed with the aid of a child lock switch. If the child lock has been applied, activation of the centre-zero switch or sensor on the internal door handle does not produce an opening signal and consequently does not cause the impinged sensor to respectively trigger the opening drive. This generally has proven to be successful.

The generic teaching of DE 197 06 393 B4 discloses a complex functionality and therefore contains various sensors for checking the safety device and the handle (internal and external handle). This results in a plurality of components being required for realizing the known motor vehicle door lock. In addition, the numerous sensors must be connected to one or several control units for evaluating their signals and controlling the opening drive. Currently this is typically achieved with the aid of so-called component carriers including respective printed conductor arrangement. In many cases, this printed conductor arrangement is designed as a lead frame requiring a complex production and installation for the reasons described in the teaching.

This means that the complex functionality of the teaching of the prior art disclosed in DE 197 06 393 B4 does not only require a plurality of sensors but also, an elaborate printed conductor arrangement in order to connect the sensors to a respective control unit or to each other and in order to actually mechanically produce all required functional states. The result is a relatively high manufacturing cost. Although this can be partly justified by the extra level of comfort offered by the "Passive Entry" function, cost pressures in the automotive sector are considerable, so that more price-effective solutions are required. The invention aims to provide a solution for this.

SUMMARY

The invention is based on the technical problem of further developing a motor vehicle door lock of the described design in such a way that it is easier to produce from a technological and design point and that manufacturing costs are lower, especially when compared to prior art embodiments.

In order to solve this technical problem, a generic motor vehicle door lock of the invention is characterized by an intermediate lever of the operating lever mechanism that mechanically implements the operator opening request optionally acts or does not act on the opening drive depending on the setting of the safety device.

The invention first of all uses a special intermediate lever as part of the operating lever mechanism. This intermediate lever mechanically implements the operator opening request. This means that said intermediate lever is, for instance, pivoted by means of a handle (internal and/or external handle) when it is opened. So as soon as an operator expresses an operator opening request by activating said handle by regularly pulling on it, this operator opening request is mechanically implemented by mechanically coupling the intermediate lever. As a result, the intermediate lever typically carries out a pivoting movement around an axle, on which it is mounted inside a housing or a lock case, etc.

The pivoting movement of the intermediate lever corresponds to the sensor, triggering the opening drive, being acted upon. The triggering of the sensor in turn causes the opening drive, acting on the locking mechanism to be triggered. As soon as the opening drive operates in the opening sense, a triggering lever is, for instance, pivoted with the aid of the opening drive, in turn lifting a pawl off a rotary latch. The locking mechanism typically comprises as usual a rotary latch and a pawl, with the pawl engaging in the rotary latch in the closed state of the locking mechanism.

The described scenario only occurs or is only implemented when the safety device is in its "released" position. If, on the other hand the safety device is in its "safe" position, the operator opening request does not lead to the described pivoting of the intermediate lever with the resulting consequences described above. In this case also the sensor triggering the opening drive is not acted upon so that the opening drive consequently does not start and open the locking mechanism.

Of special significance in this context is the fact that the safety device with its respective assumed position ("released" or "safe") ensures that the operator opening request leads to a pivoting of the intermediate lever (i.e. in the "released" position of the safety device) or not (when the safety device assumes its "safe" position). In this way, the invention only requires a single sensor.

This means that in the invention, the position of the safety device is not—as for instance in the prior art disclosed in DE 197 06 393 B4—checked by an additional sensor. Instead, the sensor recognizing the operator opening request and acted upon by the intermediate lever suffices as a single sensor of the invention, as the position of the safety device has a direct effect on whether the intermediate lever acts on the sensor or not.

A further advantage is that the intermediate lever mechanically implementing the operator opening request can be mechanically connected to the internal and external handle or both simultaneously. This means that the invention does not require separate sensors for the internal handle and the external handle, as used in the aforementioned prior art disclosed in DE 19706 393 B4. Also, the design has been simplified as alternatively or in addition to the respective handle the intermediate lever can also be acted upon by the motor in order to open the locking mechanism. This is, for instance feasible in connection with a remote control for the motor vehicle door lock or the aforementioned "Passive Entry" access.

In both situations the operator opening request conveyed, for instance, by actuation of the remote control or approaching the motor vehicle is implemented by the intermediate lever being pivoted as described. As a result of the pivoting of the intermediate lever, the sensor acted upon by the intermediate lever and triggering the opening drive is impinged on so that the locking mechanism can be directly opened with the aid of the opening drive. This naturally only applies in the case that a safety device assumes its "released" position. If, on the other hand, the safety device is in its "safe" position, the operator opening request is not translated into a pivoting movement of the intermediate lever with the described consequences.

It is in any case apparent that the motor vehicle door lock of the invention has a particularly simple design, as a single sensor suffices for implementing the "electric opening" function, taking into consideration additional checking of a safety device. This means that not only is no sensor required at the safety device as in prior art embodiments but also the printed conductor arrangement provided in the motor vehicle door lock can be simplified. The printed conductor arrangement designed in most cases as a lead frame can be implemented more simply and cost effectively than in previous arrangements. These are the main advantages.

In detail, the safety device generally contains an actuating journal. The actuating journal acts on the intermediate lever depending on the position of the safety device ("safe" or "released") during an operator opening request. In the "safe" position of the safety device, the actuating journal freewheels in relation to the intermediate lever. If, however, the safety device is in its "released" position, the actuating journal acts on the intermediate lever. As a result, the intermediate lever is pivoted as described and activates the sensor. The opening drive is then activated and produces the described electric opening of the locking mechanism.

In order to implement the different positions of the safety device, the device contains a manual actuating element. This means that according to the teaching of the invention, the safety device operates manually or by being acted upon manually. Generally, the safety device can naturally also be moved into the different position ("released" and "safe") with the aid of a motor or electric motor. For cost reasons and due to the fact that the safety device is often not acted upon in such a way, the use of a manual actuating element is recommended at this point.

In addition to the manual actuating element, the safety device of the invention also contains an actuator supporting the actuating journal. The actuator is flexibly connected to the actuating element. The actuating element is typically an actuating sprocket. In contrast, the actuator is in most cases designed as an actuating slider, flexibly connected—as described—to the actuating element or the actuating slider.

The intermediate lever is generally a blocking lever. The intermediate lever or blocking lever interacts with the opening drive. The blocking lever actually ensures in at least the standard operation that any incorrect energizing of the opening drive does not lead to an unwanted and potentially hazardous opening of the locking mechanism. For this purpose, a blocking catch of the blocking lever is in most cases engaged with the opening drive as long as no operator opening request is registered. In case of, however, such an operator opening request, the intermediate lever or the blocking lever is acted upon and pivoted. Consequently, the sensor is also acted upon and triggers the opening drive.

In the "release" position of the safety device, the blocking lever is mechanically coupled to a handle and/or an electric motor drive. The handle or the electric motor drive each convert the operator opening request. For this purpose the handle is pivoted or deflected or the electric motor drive is acted on in order to pivot the blocking lever or intermediate lever. In the "safe" position of the safety device, on the other hand, the handle and/or the electric motor drive freewheel in relation to the blocking lever.

In addition, the operating lever mechanism can contain at least one locking lever as one of its components. During standard operation, the locking lever permanently maintains its "locked" position as already described in the introduction. This means that the opening process of the locking mechanism initiated by the opening drive "overtakes the transition of the locking lever from its "locked" to its "released" position. The arrangement according to the invention is even such that the locking lever permanently retains its "locked" position—in the so-called standard operation. As a result, this produces a release lock for the opening drive. In other words, acting on the opening drive (in standard operation) corresponds to the locking lever retaining its "locked" position and as such not being able to be transferred into the "locked" position. Said release lock has thus been implemented.

Only in the emergency operation, i.e. this typically means that the voltage for supplying the opening drive is insufficient, does the locking lever assume its "released" position. This corresponds to a so-called emergency opening. The functionality during this operation is designed and arranged similar as disclosed in detail in German patent application DE (my file X 12 901), to which express reference is made in this context.

Below, the invention is explained in detail with reference to drawings showing only one embodiment, in which:

DETAILED DESCRIPTION OF THE DRAWINGS

Figure 2:
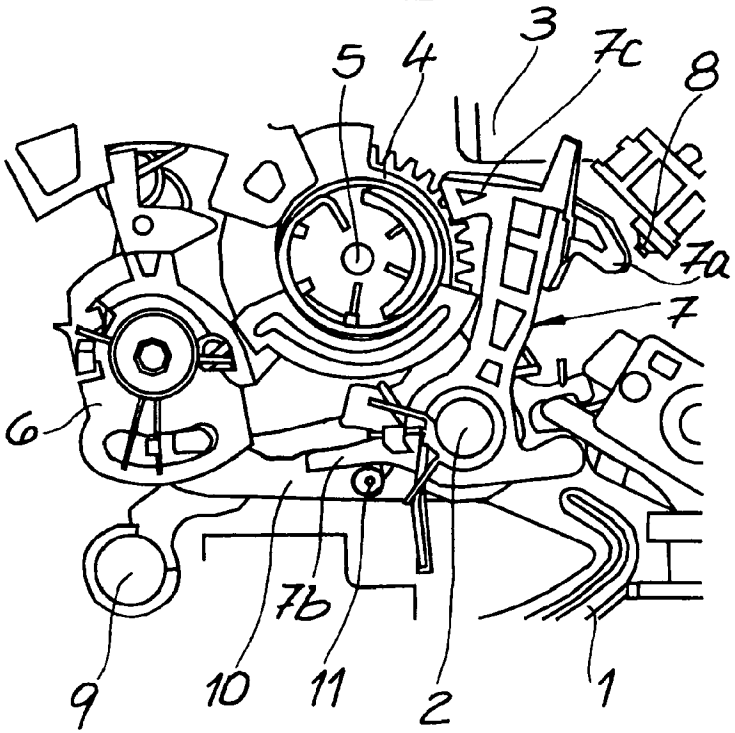
FIG. 1 shows the inventive motor vehicle door lock in the "released" and "locked" position of the safety device and FIG. 2 shows the object of FIG. 1 in the "released" and "unlocked" position.

The figures show a motor vehicle door lock containing a locking mechanism that is not expressly shown. As usual, the locking mechanism essentially comprises a rotary latch and a pawl. A release lever 1 is acting on the locking mechanism that can be pivoted around an axle 2. Pivoting movements of the release lever 1 in the shown clockwise direction in FIG. 1 around its axis 2 cause a pawl to be lifted off a rotary latch and the rotary latch is opened with the aid of a spring. In the shown embodiment an opening drive 3, 4, essentially comprising an electric motor 3 and a driven pulley 4 acted upon by the electric motor 3.

The driven pulley 4 contains an actuating cam at its rear—not shown in the drawing—acting upon the release lever 1 for opening the locking mechanism. For this purpose, the electric motor 3 acts on the driven pulley 4 in a manner that it carries out a counterclockwise movement around its axis 5 as indicated by an arrow in FIG. 1. As soon as the driven pulley 4 carries out this counterclockwise movement and the actuating cam at its rear pivots the release lever 1 around its axis 2, the locking mechanism is opened with the aid of the opening drive 3, 4.

The further basic design of the shown motor vehicle door lock contains an operating lever mechanism 6, 7. Only a locking lever 6 and an intermediate lever 7 or blocking lever 7 are shown of the operating lever mechanism. Naturally the operating lever mechanism 6, 7 also includes other levers not expressly listed, which are, however, not relevant for the below description.

The figures furthermore show a sensor 8, being in this case a switch or micro switch 8. The switch 8 can be acted upon with the aid of an intermediate lever or blocking lever 7. In order to achieve this, the intermediate lever or blocking lever 7 must be pivoted around its axis 2 in clockwise direction.

The intermediate lever or blocking lever 7 is actually mounted on the same axis as the release lever 1 on a common axis 2. A clockwise movement of the intermediate lever or of the blocking lever 7 around the respective axis 2 causes the actuating cam 7*a* of the blocking lever 7 to act on the sensor or switch 8. The associated switch position or change to the switch position is interpreted by a connected control unit as a switch position or change of switch position and causes the opening drive 3, 4 to be acted upon in the embodiment.

Figure 1:
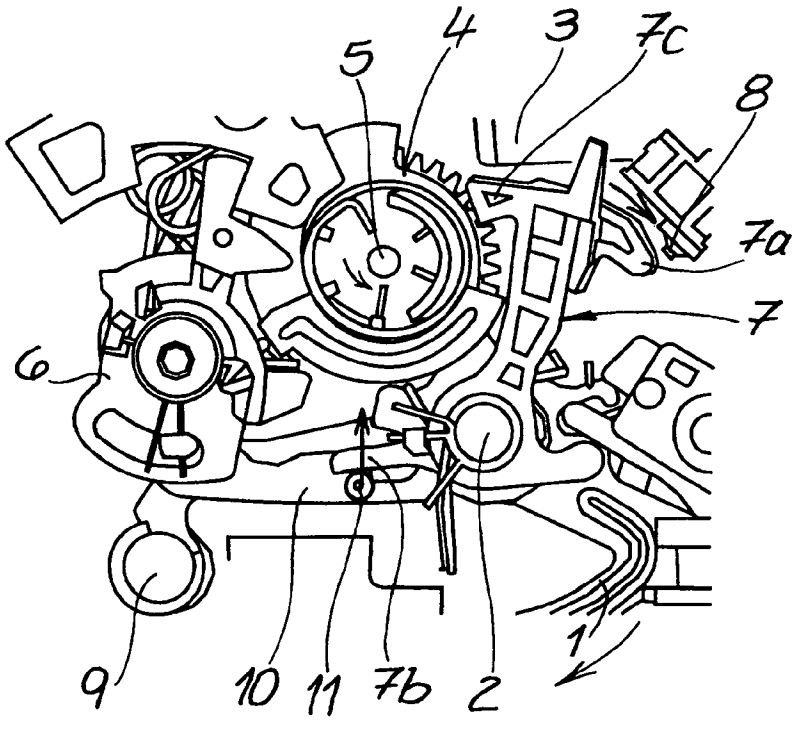

This does indeed cause an opening movement of the locking mechanism. This means that after actuating the sensor or switch 8, the opening drive 3, 4 is acted upon by the control unit—not shown—in such a way that the driven pulley 4 carries out its counterclockwise movement around the axis 5, as indicated in FIG. 1, pivoting the release lever 1 in clockwise direction during this process. As a result, the pawl is lifted off the rotary latch so that the locking mechanism is then opened.

Finally, the figures also show a safety device 9, 10, 11, which in this case is a child lock 9, 10, 11. The safety device 9, 10, 11 can generally assume two positions. In FIGS. 1 and 2, the safety device or child lock 9, 10, 11 is in the "released" "child lock off" position. In contrast, the functional position in FIGS. 3 and 4 corresponds to the "safe" position of the safety device 9, 10, 11, or "child lock on".

At least in the "safe" position of the safety device 9, 10, 11 (see FIGS. 3 and 4), the safety device or child lock 9, 10, 11 prevents opening of the locking mechanism. With the aid of a sensor or switch 8 an operator opening request is checked, as explained in detail below. This operator opening request is actually mechanically implemented with the aid of the intermediate lever 7 of the operating lever mechanism 6, 7. In the invention this is implemented in accordance with the position of the safety device 9, 10, 11.

At the same time, the overall design is such that the intermediate lever or blocking lever 7 mechanically converts the operator opening request to selectively act or not act on the sensor 8 which actuates the opening drive 3, 4 depending on the position of the safety device 9, 10, 11.

If the safety device or child lock 9, 10, 11 is in its "released" or "child lock off" position (see FIGS. 1 and 2), the intermediate lever or blocking lever 7, mechanically implementing the operator opening request, can act on the sensor 8. For this purpose, the safety device 9, 10, 11 contains an actuating journal 11. In the "released" position of the safety device 9, 10, 11 the actuating journal 11 acts on the intermediate lever or blocking lever 7 in case of an operator opening request in the direction shown by the arrow in the figures and in the sense of an upwards movement. As a result, the actuating journal 11 moves against the intermediate lever or blocking lever 7 or a blocking catch 7*b*, so that as a result of this movement, the intermediate lever or blocking lever 7 is pivoted around its axis 2 in clockwise direction and operates the sensor or switch 8.

During this process, a blocking catch 7*c* of the intermediate lever or blocking lever 7 disengages from the driven pulley 4. As a result, the sensor or switch 8 can act on the opening drive 3, 4 which then moves the driven pulley 4 in counter-clockwise direction, as described so that the release lever 1, moved in clockwise direction, lifts the pawl off the locking mechanism. At the end off this process, the locking mechanism is open.

As long as the blocking catch 7*c* engages the driven pulley 4, such opening movements are not possible, as the blocking catch 7*c* respectively blocks the movement of the driven pulley 4. This ensures that incorrect energizing of the opening drive 3, 4 does or can not cause unwanted opening of the locking mechanism.

The safety device 9, 10, 11 contains a manual actuating element 9 in form of an actuating cam 9. Also an actuator 10 is provided on which the actuating journal 11 is mounted, said actuator in this case being an actuating slider 10. The actuating slider or the actuator 10 is flexibly connected to the actuating element or the actuating cam 9.

In the "released" position of the safety device 9, 10, 11 or "child lock off" (see FIGS. 1 and 2), the blocking lever 7 is mechanically coupled to a handle—not shown—and/or an electric motor connection—also not shown. Both, the handle and the electric motor drive converts an operator opening request in such a way that the actuating journal 11 of the safety device 9, 10, 11 is acted upon in the direction of the arrow indicated in the figures in the sense of an upward movement. For this purpose, the handle can act on the actuating journal 11 using respective actuators. A similar process applies for the electrical motor drive. As already described, the operator opening request in the "released" position of the safety device 9, 10, 11 or the "child lock off" position of the child lock 9, 10, 11 causes the blocking lever 7 to be pivoted around its axis 2 in clockwise direction with the aid of the actuating journal 11, being acted upon in the sense of an upward movement. As a result, the sensor or switch 8 is activated and the opening drive 3, 4, is triggered to open the locking mechanism.

Figure 4:
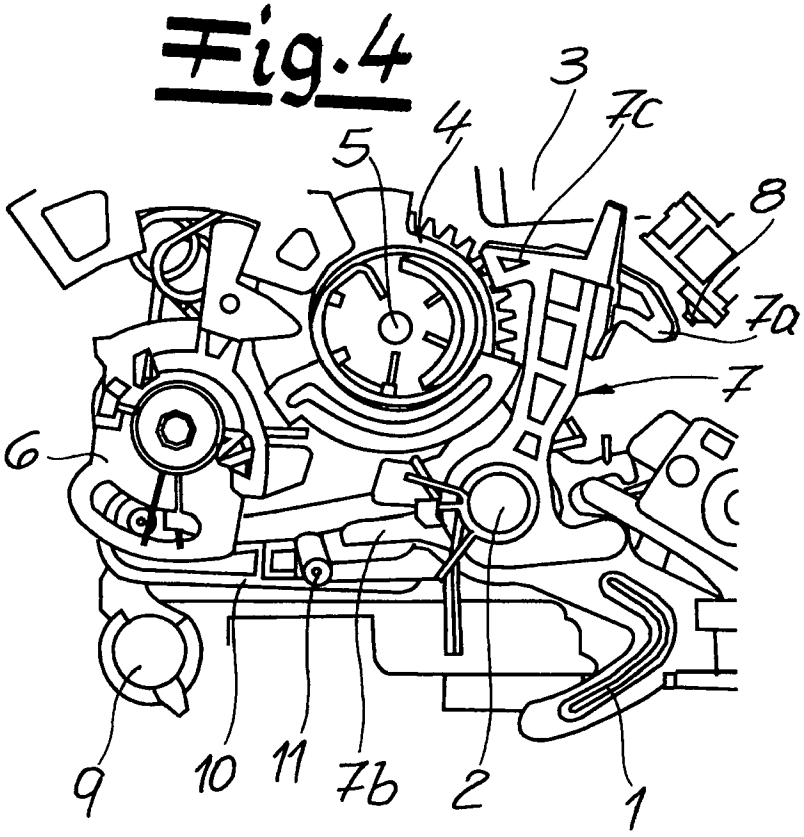
FIG. 3 shows the motor vehicle door lock and the safety device in the "safe" and "unlocked" position and FIG. 4 shows the object of FIG. 3 in the "safe" and "locked" position
Figure 3:
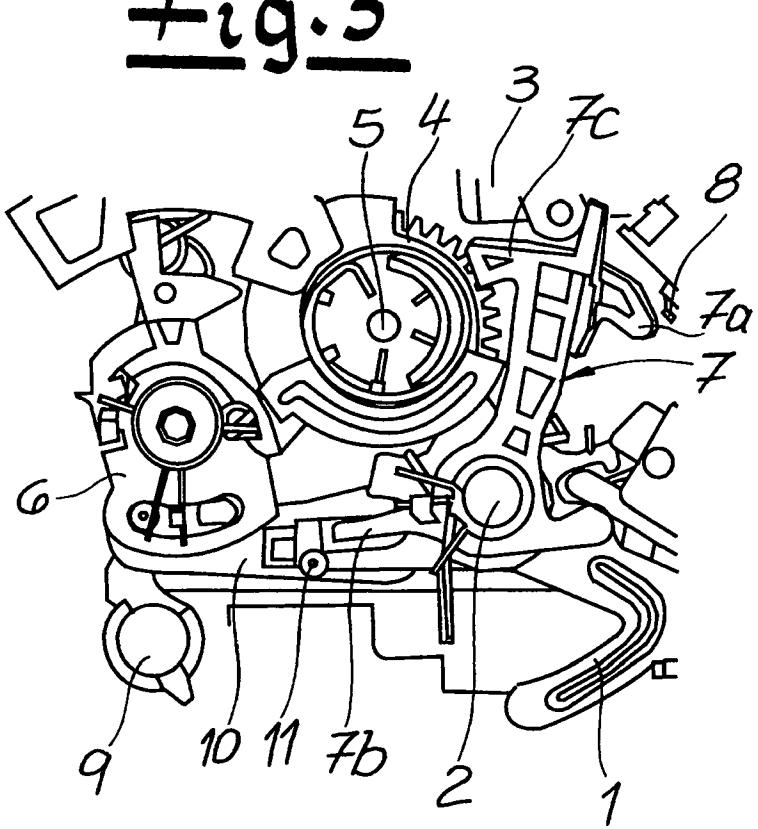

In contrast, the handle or the electric motor drive freewheels in relation to the blocking lever 7 or the electric motor drive in the "safe" position of the safety device 9, 10, 11 or in the position "child lock on" of the child lock (see FIGS. 3 and 4). Respective acting on the actuating journal 11 in the sense of an upwards movement results in the associated FIGS. 3 and 4 in freewheeling in relation to the blocking lever 7. This is due to the fact that during this process the actuating journal 11 does not reach the actuating cam 7*b* of the blocking lever 7 and moves past it.

For the purpose of the description, the operating lever mechanism 6, 7 does not only include the intermediate lever or blocking lever 7 but also the aforementioned locking lever 6. In FIGS. 1 and 4, the locking lever 6 is in its "locked" position. In contrast, the position in FIGS. 2 and 3 corresponds to the "unlocked" position of the locking lever 6. In standard operation and when the safety device 9, 10, 11 is in the "released" or "child lock off" position, the locking lever 6 constantly maintains its "locked" position. As a result, the described safety lock of the opening drive 3, 4 has been implemented. As long as the safety device 9, 10, 11 maintains its "released" or "child lock off" position, the position of the locking lever 6 ("unlocked" or "locked") is of no importance for the implementation of the operator opening request.

This means that with the aid of the intermediate lever 7, the operator opening request is always mechanically converted to an opening of the locking mechanism when the handle is acted upon and/or the electric motor drive is operated, as soon as the safety device 9, 10, 11 assumes its "released" position. The position of the locking lever 6 is immaterial for this purpose. This becomes apparent when comparing FIGS. 1 and 2. The figures show that the actuating journal 11, converting the operator opening request, acts on the actuating cam 7*b* of the blocking lever 7 when the locking lever 6 is in the "locked" position and when the locking lever 6 is in its "unlocked" position as shown in FIG. 2. In this context it is important that the safety device 9, 10, 11 assumes or has assumed its "released" position.

If the safety device 9, 10, 11 is, however, in its "safe" position or the child lock 9, 10, 11 is in the "child lock on" position, the actuating journal 11 constantly freewheels in relation to the actuating cam 7*b* of the blocking lever 7 and irrespective of the position of the locking lever 6. In FIG. 3 said locking lever 6 is in its "unlocked" and in FIG. 4 in its "locked" position. In both situations, the position of the safety device 9, 10, 11 "safe" ensures that the actuating journal 11 moves past the actuating cam 7*b* of the blocking lever 7 resulting in said freewheeling.

The invention claimed is:

1. A motor vehicle door lock with a locking mechanism comprising a rotary latch and a paw, the door lock further comprising an opening drive comprising an electric motor and a driven pulley, the driven pulley comprising a driven gear acted upon by the electric motor, and said opening drive acting on the locking mechanism and, an operating lever mechanism comprising at least one sensor for checking an operator opening request, and one safety device which prevents the locking mechanism from opening at least in a "safe" position of the safety device, wherein an intermediate lever of the operating lever mechanism acts as a blocking lever in a first position of the intermediate lever to block said driven gear and the intermediate lever is pivotable around an axis in a clockwise direction, and said intermediate lever mechanically converts the operator opening request by a clockwise movement of the intermediate lever around its respective axis to a second position causing an actuating cam to selectively act on the sensor which actuates the opening drive depending on the position of the safety device.

2. The motor vehicle door lock according to claim 1, wherein the safety device contains an actuating journal, which depending on its position ("released" or "safe") acts on the intermediate lever after an operator opening request in order to actuate the sensor or freewheel in relation to the intermediate lever.

3. The motor vehicle door lock according to claim 2, wherein the safety device operates manually.

4. The motor vehicle door lock according to claim 3, wherein the safety device contains a manual actuating element and an actuator supporting the actuating journal.

5. The motor vehicle door lock according to claim 4, wherein the actuating element is an actuating cam and the actuator is flexibly connected to the actuating element.

6. The motor vehicle door lock according to claim 5, wherein the actuator is an actuating slider.

7. The motor vehicle door lock according to claim 6, wherein blocking lever in the "released" position of the safety device is mechanically coupled to a handle and/or an electric motor drive, whilst in the "safe" position of the safety device the handle and or the electric motor drive freewheel in relation to the blocking lever.

8. The motor vehicle door lock according to claim 7, wherein the safety device is a child lock.

9. The motor vehicle door lock according to claim 8, wherein the additional at least one locking lever is provided as part of the operating lever mechanism.

10. The motor vehicle door lock according to claim 4, wherein the actuator is an actuating slider.

11. The motor vehicle door lock according to claim 2, wherein the intermediate lever is a blocking lever interacting with the opening drive.

12. The motor vehicle door lock according to claim 11, wherein blocking lever in the "released" position of the safety device is mechanically coupled to a handle and/or an electric motor drive, whilst in the "safe" position of the safety device the handle and or the electric motor drive freewheel in relation to the blocking lever.

13. The motor vehicle door lock according to claim 1, wherein the safety device is a child lock.

14. The motor vehicle door lock according to claim 1, wherein the additional at least one locking lever is provided as part of the handle mechanism.

15. A door lock for a door on a motor vehicle, the door having an operating lever that generates an opening request, the door lock comprising:

a locking mechanism having a closed state for locking the door and an opened state for unlocking the door, the locking mechanism comprising a rotary latch and a paw;

a safety device having a "safe" position, which prevents the locking mechanism from opening at least in its "safe" position;

an opening drive comprising an electric motor and a pulley, the pulley comprising a gear mechanically coupled to said electric motor, wherein said opening drive acts on said locking mechanism to lock or unlock said locking mechanism depending on the state of said safety device;

an intermediate lever movable between a first position and a second position, wherein said opening request mechanically moves said intermediate lever to the second position, and wherein said intermediate lever blocks movement of said gear when said intermediate lever is in the first position;

a sensor that detects when said intermediate lever is in the second position to actuate said opening drive.

* * * * *